United States Patent [19]

Graf

[11] 4,393,781

[45] Jul. 19, 1983

[54] FUZE FOR LIQUID SHELL PROPELLANTS

[75] Inventor: Manfred Graf, Düsseldorf, Fed. Rep. of Germany

[73] Assignee: Rheinmetall GmbH, Düsseldorf, Fed. Rep. of Germany

[21] Appl. No.: 337,093

[22] Filed: Feb. 26, 1973

[30] Foreign Application Priority Data

Apr. 13, 1972 [DE] Fed. Rep. of Germany ..... 2217728

[51] Int. Cl.[3] ..... F42B 5/16; F42B 9/14

[52] U.S. Cl. ..... 102/440; 89/7

[58] Field of Search ..... 102/38, 40, 44, 45; 89/7, 8

[56] References Cited

U.S. PATENT DOCUMENTS

| | | | |
|---|---|---|---|
| 2,995,987 | 8/1961 | Fitzpatrick | 89/7 |
| 3,044,363 | 7/1962 | Musser | 89/8 |
| 3,439,635 | 4/1969 | Hensley | 102/40 X |
| 3,645,206 | 2/1972 | Quinlan et al. | 102/40 |

FOREIGN PATENT DOCUMENTS

| | | | |
|---|---|---|---|
| 399252 | 9/1965 | Switzerland | 89/7 |

*Primary Examiner*—Charles T. Jordan
*Attorney, Agent, or Firm*—Karl F. Ross

[57] ABSTRACT

A fuze for the firing of a projectile from a gun barrel comprises a breech piece threaded onto the rear end of the barrel and defining therewith a cylindrical chamber for a charge of liquid propellant to be tangentially introduced upon insertion into the barrel of the projectile to be fired. A pyrotechnical detonator is carried on the aft end of the projectile and extends rearwardly therefrom into the chamber when the projectile is thus emplaced, with the injected propellant circulating around it. The projectile is discharged upon ignition of the detonator by a firing pin. The pin is guided in a plunger surrounded by a retractable sleeve which serves to position the shell in the barrel by engaging an area of its aft end surrounding the detonator.

2 Claims, 3 Drawing Figures

FUZE FOR LIQUID SHELL PROPELLANTS

The present invention relates to a fuze for firing a projectile or shell by means of a liquid propellant.

It is known to fire shells from a gun barrel by the energy of high-pressure gases evolving from the ignition of liquid charges. For this purpose the liquid charge is introduced into a charge chamber disposed adjacent the aft end of the inserted shell. The ignition is usually effected by an electrical detonator with two electrodes penetrating into the charge chamber, a high voltage being developed across these electrodes by means of an electrical generator whereby a spark initiates the transformation of the liquid propellant into the desired gaseous reaction products.

As advantageous as is this type of propellant ignition in dispensing with the conventional pyrotechnical detonating mechanisms including a percussion cap, firing pin and booster charges, a perfect ignition is dependent upon the production of high-voltage discharges. Aside from the fact that each gun designed for electric ignition must be equipped with a generator producing the required high voltages, it is difficult to transmit these high voltages safely to the ignition electrode.

It has already been proposed to dispose the liquid charge, in the manner long known for solid propellants, in the rear part of the shell body and to provide at its aft end a pyrotechnical detonator in the form of an igniter and a transmission fuze.

It is also known to place a detonator in the charge chamber for setting off a liquid charge in that chamber by means of a firing pin.

It is the object of the present invention to provide an improved fuze for liquid propellants, used in the firing of projectiles from a gun barrel, which avoids the above-mentioned drawbacks, operates safely even under extreme external conditions, is of very simple structure and minimizes the expenditure for ancillary equipment.

According to the present invention I provide a fuze for liquid propellants wherein a pyrotechnical detonator is disposed at the aft end of a projectile or shell to be fired, the diameter of the detonator being less than the shell caliber. Upon emplacement of the shell in the gun barrel by suitable positioning means, the primer projects with its full depth rearwardly into a charge chamber defined by a breech piece secured to the rear end of the barrel. At least one conduit opens tangentially into this chamber to enable the injection of a liquid propellant into same with a circulatory motion around the detonator which is then set off by ignition means such as a firing pin.

An embodiment of my invention will now be described in detail with reference to the accompanying drawing in which.

Figure 1:
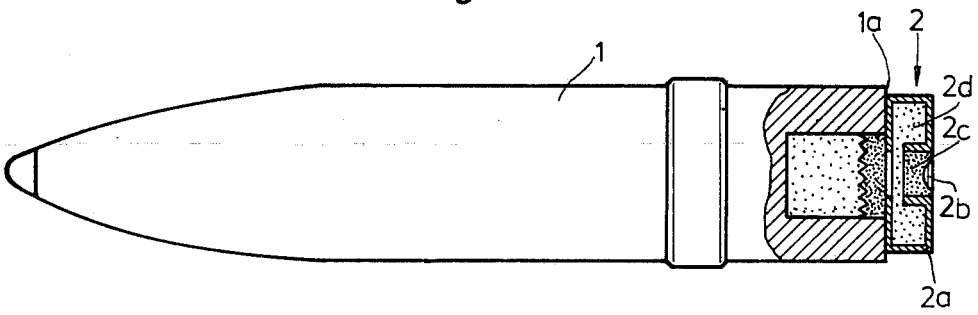
FIG. 1 is an elevational view, partly in section, of a spin-stabilized tracer shell carrying a pyrotechnical detonator at its aft end.
Figure 2:
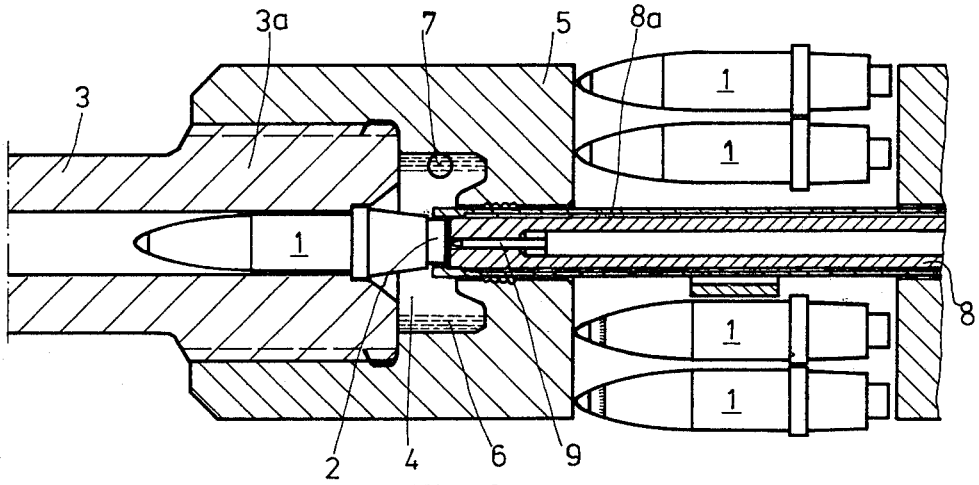
FIG. 2 is a longitudinal sectional view of a charge chamber surrounding the shell of FIG. 1.
Figure 3:
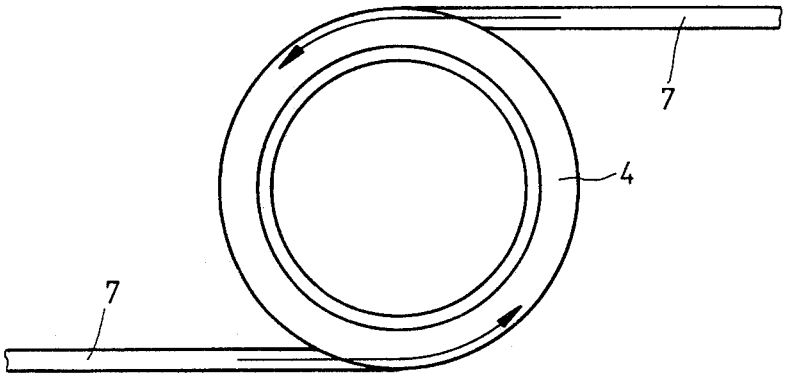
FIG. 3 is a schematic showing of the charge chamber with two tangential feeding conduits.

As shown in the drawing, a conventional spin-stabilized tracer shell 1 carries at its aft end 1*a* a mechanically ignitable detonator 2. The latter consists of a capsule 2*a*, containing a primer 2*b*, an intensifier charge 2*c* and a booster charge 2*d*. The capsule 2*a* consists preferably of a suitable combustible material and can be connected with the shell end 1*a* by beading, adhesive or other means. The shell 1 inserted into a gun barrel 3 projects with its detonator 2 into an annular charge chamber 4 defined by a cylindrical recess in a breech piece 5, which in turn is screwed onto the barrel end 3*a*.

The feeding of the charge chamber 4 with the liquid propellant 6 takes place via one or more supply conduits 7 which are disposed tangentially to the charge chamber 4. In the illustrated embodiment two types of shells are fed from opposite sides. The choice of the desired type of shell is made by means of a selection switch (not shown) whereby a plunger 8 is axially retracted far enough to position the selected shell in a feed channel from which it can be advanced into firing position by the forwardly moving plunger 8.

In order to avoid a direct engagement of the detonator 2 in its thin-walled capsule with the front face of the plunger 8, which could damage or even destroy the detonator, I prefer to slip a sleeve 8*a* over the plunger 8, this tubular member extending beyond the plunger past the capsule 2*a* and engaging the shell end 1*a*. After inserting the shell 1 into the barrel 3, the sleeve 8*a* can be withdrawn to the front face of the plunger 8. During the positioning of the shell 1 an exactly dosed quantity of liquid propellant 6 is pumped through conduits 7 into the charge chamber 4, under a pressure high enough to make the liquid circulate within the inner wall of the charge chamber 4 about the capsule 2*a*. The diameter of the charge chamber 4 is so dimensioned, that the introduction of the propellant 6 and the emplacement of the shell can be effected simultaneously.

Upon termination of the loading and filling procedure, a firing pin 9 provided in the plunger 8 strikes the primer 2*b* under the control of a trigger (not shown), whereby the intensifier charge 2*c*, the booster charge 2*d* and finally the liquid propellant 6 are successively ignited.

The resulting gas pressure building up in the charge chamber 4 propels the shell 1 through the gun barrel 3.

Some variations are possible within the framework of the present invention. Thus, instead of mechanical ignition by impact it may use electric ignition of the detonator. This has the advantage that a comparatively low voltage and current will suffice. A further advantage of electrical ignition resides in the fact that the shell, even if its aft end lacks special holding means for a detonator, can be fired also from guns equipped with charge chambers for the reception of cartridges.

While I have disclosed one embodiment of the present invention, it is to be understood that this embodiment is given by way of example only and not in a limiting sense.

I claim:

1. A fuze for firing a projectile from a gun barrel, comprising:

a pyrotechnical detonator disposed at the aft end of a projectile to be fired, said detonator having a diameter less than the caliber of said projectile;

a breech piece secured to the rear end of the gun barrel and defining therewith a charge chamber centered on an axis;

positioning means for emplacing said projectile in said gun barrel with said detonator extending rearwardly into said charge chamber along said axis, said breech piece being provided with at least one conduit opening tangentially into said charge chamber for injecting a liquid propellant into same with circulatory motion around said detonator; and igniting means for setting off said detonator in the presence of the circulating propellant.

2. A fuze as defined in claim 1 wherein said positioning means comprises a tubular member slidable along said axis and engageable with an area of said aft end surrounding said detonator.

* * * * *